US005419737A

United States Patent [19]

Brazell et al.

[11] Patent Number: 5,419,737

[45] Date of Patent: May 30, 1995

[54] RANDOM ORBITAL SANDING MACHINE HAVING A REMOVABLE DEBRIS CONTAINER

[75] Inventors: Kenneth M. Brazell, Phoenix; Robert G. Everts; Naoki Kikuchi, both of Chandler, all of Ariz.

[73] Assignee: Ryobi Motor Products Corp., Easley, S.C.

[21] Appl. No.: 145,801

[22] Filed: Oct. 28, 1993

[51] Int. Cl.[6] ..... B24B 23/00; B24B 23/04

[52] U.S. Cl. ..... 451/453; 451/354; 451/357; 451/456

[58] Field of Search ..... 451/354, 357, 453, 456

[56] References Cited

U.S. PATENT DOCUMENTS

| | | | |
|---|---|---|---|
| D. 323,963 | 2/1992 | Bunyea | D8/62 |
| D. 326,398 | 5/1992 | Fushiya et al. | D8/62 |
| 2,439,596 | 10/1946 | Crosby | 51/170 |
| 4,071,981 | 2/1978 | Champayne | 51/170 MT |
| 4,355,487 | 10/1982 | Maier et al. | 51/170 MT |
| 4,381,628 | 5/1983 | Dicke | 51/170 TL |
| 4,434,587 | 2/1984 | McDougall | 51/170 MT |
| 4,549,371 | 10/1985 | Hakoda | 51/170 MT |
| 4,729,195 | 3/1988 | Berger | 51/170 MT |
| 4,930,264 | 6/1990 | Huang | 51/170 T |
| 4,967,516 | 11/1990 | Hoshino et al. | 51/170 R |
| 5,018,314 | 5/1991 | Fushiya et al. | 51/170 MT |
| 5,105,585 | 4/1992 | Hampl et al. | 51/170 R |

FOREIGN PATENT DOCUMENTS

| | | |
|---|---|---|
| 2255999 | 7/1975 | France . |
| 2420276 | 11/1979 | France . |
| 2312360 | 9/1974 | Germany . |
| 2542183 | 4/1976 | Germany . |
| 1407628 | 9/1975 | United Kingdom . |

*Primary Examiner*—Bruce M. Kisliuk
*Assistant Examiner*—Yasser El-Gamal
*Attorney, Agent, or Firm*—Brooks & Kushman

[57] ABSTRACT

A palm grip random orbital sanding machine having a housing and an electric motor disposed in the housing which drives an attached platen along a random orbital path. An exhaust fan disposed in an exhaust chamber produces an air flow from the vicinity of the platen out through an exhaust port. The housing has a pair of longitudinal slots provided on opposite sides thereof which removably receive the legs or side members of a U-shaped debris container. Each side member of the debris container has an entrance port coincident with the exhaust port of the exhaust chamber, and means for filtering the debris from the air flow exiting the side members. The commutator and brushes of the electric motor are disposed intermediate the longitudinal slots and the brushes are disposed parallel to the longitudinal axis of the sanding machine.

27 Claims, 7 Drawing Sheets

Fig-12
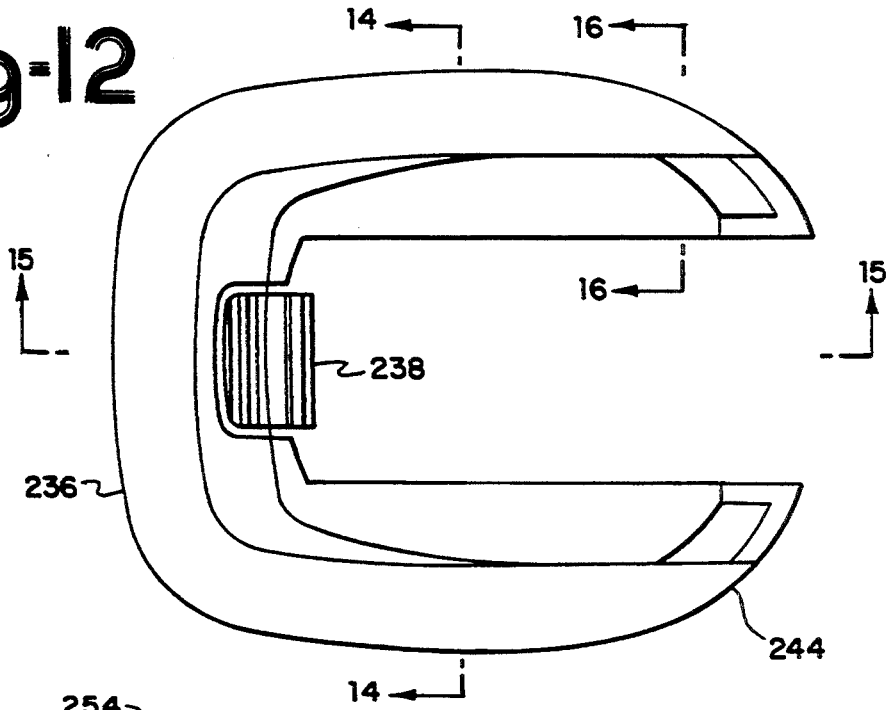
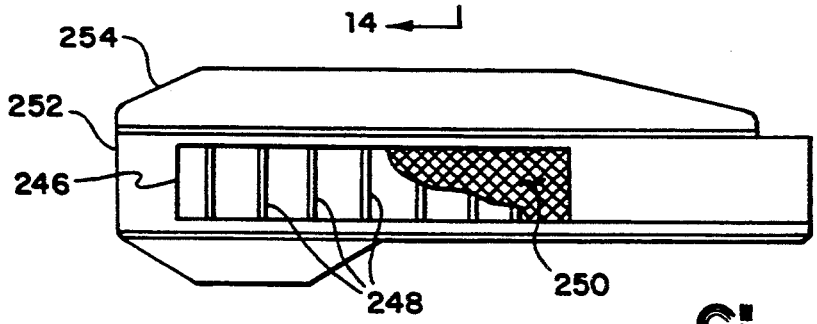
Fig-13
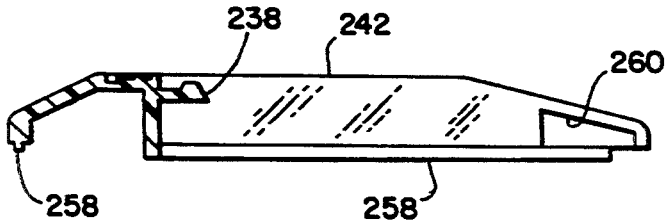
Fig-15
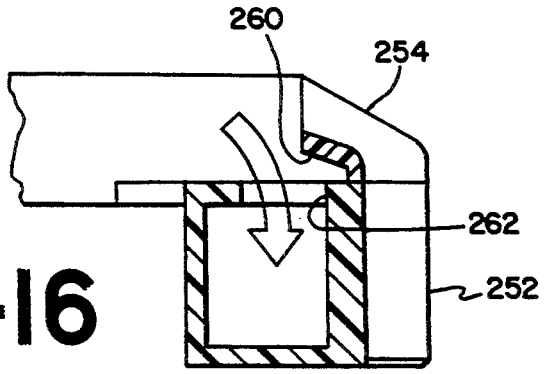
Fig-16

RANDOM ORBITAL SANDING MACHINE HAVING A REMOVABLE DEBRIS CONTAINER

TECHNICAL FIELD

This invention relates to electric powered portable surface treating tools and, in particular, to a random orbital sanding machine having a removable debris container.

BACKGROUND ART

Electrically powered portable surface treating mechanisms such as sanding machines have a platen on which an abrasive element, such as a sheet of sandpaper, is attached. The debris, i.e. sanding dust, created by the operation of the sanding machine is a nuisance to the operation of the machine, and numerous arrangements have been made to remove this debris from the work area.

Hoshino et al in U.S. Pat. No. 4,967,516 discloses a debris collection system for an orbital sanding machine having a centrifugal fan attached to the output shaft of the electric motor. The centrifugal fan creates an air flow which draws the debris up through apertures provided through the abrasive element and the platen and deposits it in a removable debris container attached to the rear of the sanding machine.

Other types of debris removal arrangements for sanding machines are taught by Maier et al in U.S. Pat. No. 4,355,487, Berger in U.S. Pat. No. 4,729,195 and by Fushiya et al in U.S. Pat. No. 5,018,314.

SUMMARY OF THE INVENTION

The invention is a palm grip sanding machine and, in particular, a portable palm grip random orbital sanding machine having a housing which has a pair of longitudinal slots provided on opposite sides thereof. An electric motor is disposed in the housing having a vertically oriented output shaft. An eccentric connects the end of the motor's output shaft to a platen. The platen has a surface normal to the output shaft which supports an abrasive element. An exhaust fan chamber is provided in the housing in a region adjacent to the platen. The exhaust fan chamber has a centrally disposed intake port adjacent to the platen and an exhaust port. An exhaust fan, connected to the output shaft, produces an air flow through said exhaust fan chamber from the intake port out through the exhaust port. The air flow being sufficient to carry debris from the vicinity of the platen through the exhaust fan chamber and out the exhaust port. A U-shaped debris container is removably attachable to the housing. The U-shaped debris container has a pair of spatially separated substantially parallel hollow side members slidably receivable in the longitudinal slots provided in the housing. Each hollow side member having an entrance port aligned with the exhaust port when the debris container is mounted in the longitudinal slots. Each hollow side member having filter means for removing the sanding dust and debris from the air flow as it exits the hollow side members.

In a first embodiment, each side member has at least one exit port and the filter means consists of a woven mesh filter disposed in each exit port. Alternatively, the U-shaped debris container may be molded from a porous plastic material and the side walls of the U-shaped debris container function as the filter element.

One advantage of the sanding machine is that the output shaft of the electric motor is transverse to the platen.

Another advantage is that the fan producing an air flow cooling the motor and the fan producing an air flow drawing up the debris are provided on opposite sides of a common rotor.

Still another advantage is that the commutator and the associated brushes of the electric motor are located in the housing intermediate the pair of longitudinal slots and the brushes are oriented parallel to the longitudinal axis of the housing permitting the depth of the slots and the volume of the hollow side members to be increased.

These and other advantages will become more apparent from a reading of the detailed description of the invention in conjunction with the drawings.

BRIEF DESCRIPTION OF THE DRAWINGS

FIG. 12 is a top view of the debris container;

FIG. 13 is a side view of the debris container;

FIG. 15 is a cross-sectional view taken along section line 15—15 of FIG. 12;

FIG. 16 is a partial cross-sectional view taken along section line 16—16 of FIG. 12;

DETAILED DESCRIPTION OF THE INVENTION

Figure 1:
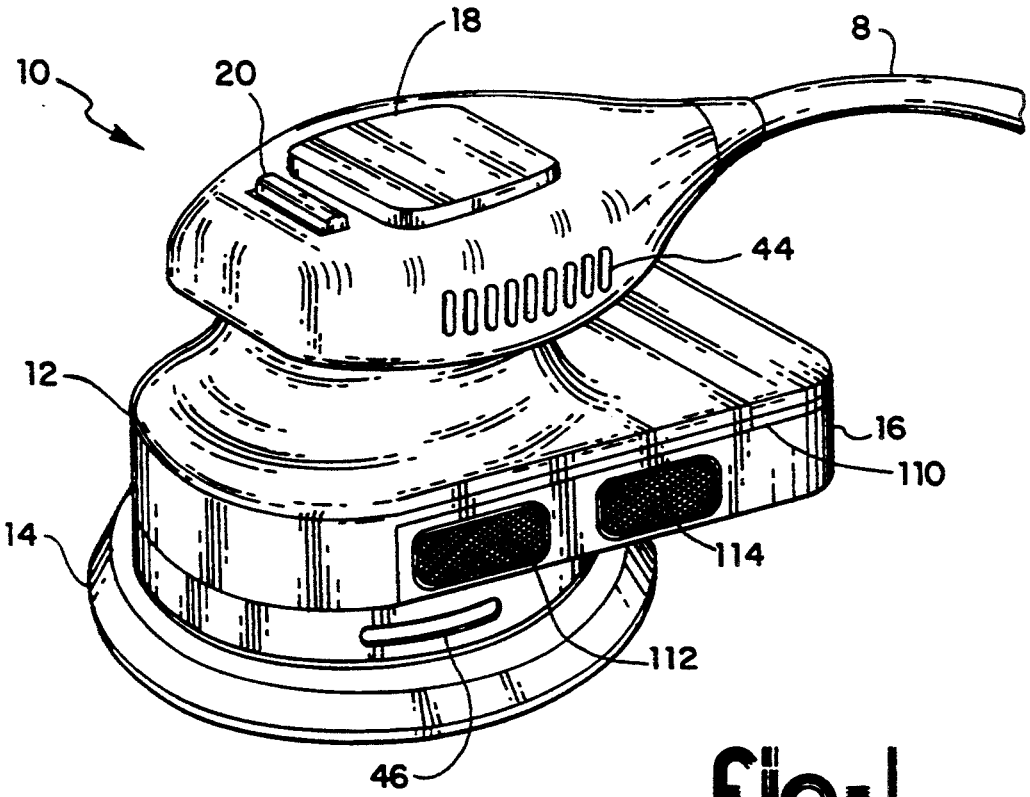
FIG. 1 is a perspective view of the portable random orbital sanding machine.

FIG. 1 is a perspective view of a first embodiment of the random orbital sanding machine 10 of the invention. The random orbital sanding machine 10 has a housing 12, a sanding pad or platen 14 and a removable debris container 16. A palm switch actuator 18 is located on the top of the housing 12 and a lockout button 20 is located forward of the palm switch actuator 18. An electrical cord 8 connectable to a household electrical outlet provides electrical power to the orbital sanding machine 10.

Figure 2:
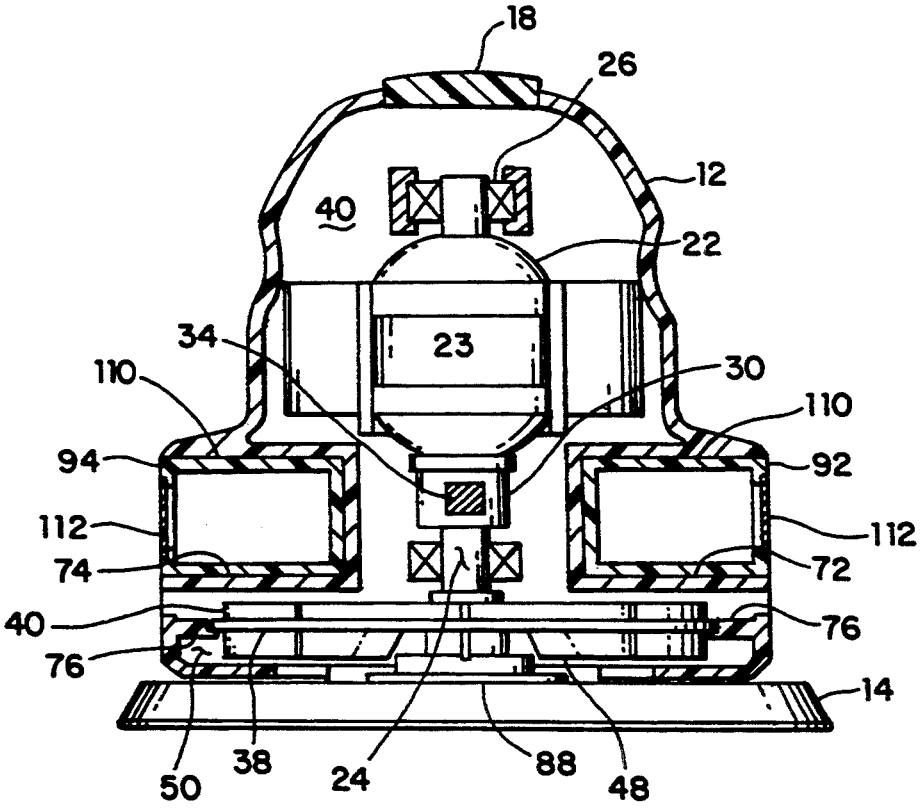
FIG. 2 is a transverse cross-sectional view of the sanding machine.
Figure 3:
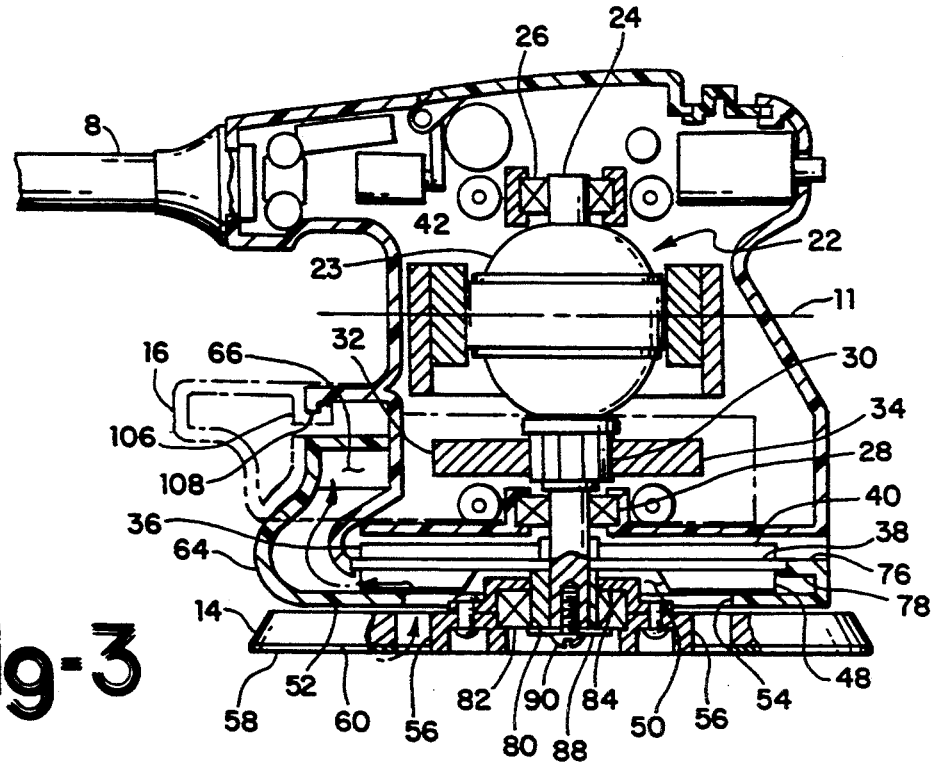
FIG. 3 is a cross-sectional side view of the sanding machine.

As shown in FIGS. 2 and 3, the housing 12 encloses and internally supports an electric motor 22 having an armature 23 and a rotary output shaft 24. The rotary output shaft 24 is rotatably supported within the housing 12 by an upper bearing 26 and a lower bearing 28. The upper an lower bearings 26 and 28, respectively, are preferably ball bearings but may be roller bearings or bronze bushings. A commutator 30 is attached to the rotary output shaft 24 in the region adjacent to lower bearing 28 in the lower portion of housing 12. The commutator 30 is engaged, in a conventional manner, by a pair of brushes 32 and 34 disposed parallel to the longitudinal axis 11 of the housing 12.

A fan 36 is attached to the lower end of the shaft 24 and is rotatable therewith. The end of the shaft 24 may have a male spline which is received in a mating female spline provided in the hub of the fan 36, the end of the shaft may have any non-circular profile which mates with a corresponding non-circular bore provided in the hub of the fan 36 or the fan may be keyed to the shaft 24 to inhibit its independent rotation. The fan 36 has a radially extending rotor disc 38 to which a first set of fan blades 40 are provided on an upper surface. The first set of fan blades 40 produces a cooling air flow through the motor chamber 42 of the housing 12. This cooling air flow enters the motor chamber 42 through the inlet vents 44 shown in FIG. 1 and exits the motor chamber 40 through the exhaust vents 46 disposed on opposite sides of the housing 12.

Figure 4:
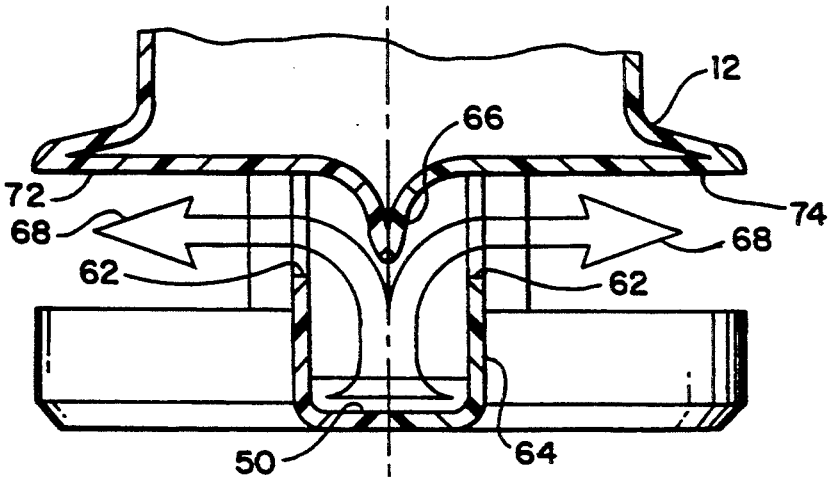
FIG. 4 is a partial cross-sectional rear view with the debris container removed.

A second set of fan blades 48 are provided on the lower surface of the rotor disc 38. The second set of fan blades 48 are disposed in an exhaust fan chamber 50 defined between the rotor disc 38 and a base portion 52 of the housing 12. The base portion 52 has a centrally disposed suction aperture 54 having a diameter sufficiently large to encompass the apertures 56 provided through the platen 14. An abrasive member 58 (i.e. sandpaper) fastened to the lower surface 60 of the platen 14 has openings aligned with the apertures 56 provided through the platen. The exhaust fan chamber 50 is connected to a pair of exhaust ports 62 provided through the walls of the housing 12 by a conduit 64 as more clearly shown in FIG. 4. The conduit 64 may include a substantially vertical air flow divider 66 to substantially balance the air flow, indicated by arrows 68 through each of the dust exhaust ports 62.

As further shown in FIG. 3, the arrangement of the brushes 32 and 34 parallel to the longitudinal axis of the housing 12, permits the waist portion 70 of the sanding machine 10 to be narrowed considerably which permits the depth of a pair of debris container slots 72 and 74 provided on opposite sides of the housing 12 to be substantially increased. The slots 72 and 74 receive, respectfully, portions of the debris container 16 which has a horseshoe-type shape. The horseshoe-shaped debris container 16 straddles the waist portion 70 of the housing 12 with its parallel side members received in the longitudinal slots 72 and 74. This horseshoe-shaped debris container 16 utilizes normally wasted volume of the housing 12. This significantly increasing its internal volume of the debris container 16 and therefore its debris collection capacity.

Returning to FIG. 2, the housing 12 has an internal rib 76 which, in cooperation with rotor disc 38, physically separates the motor chamber 42 from the exhaust fan chamber 50 keeping the motor chamber 42 and its internal components relatively dust-free. The rib 76 may have an annular lip 78 extending inwardly below the rotor disc 38 to more effectively isolate the motor chamber 42 from the exhaust fan chamber 50.

The fan member 36 has an eccentric hub 80 rotatably connected to the platen 14 by a bearing 82 and a cup-shaped bracket 84. The bracket 84 is attached to the platen 14 by a set of fasteners, such as rivets, equally spaced around its periphery as shown. The bracket 84 secures the outer race of bearing 82 to the platen 14 while a washer 88 attached to the end of the shaft 24 by a bolt 90 locks the inner race of the bearing 82 between the bracket 84 and the end of the shaft 24.

Figure 5:
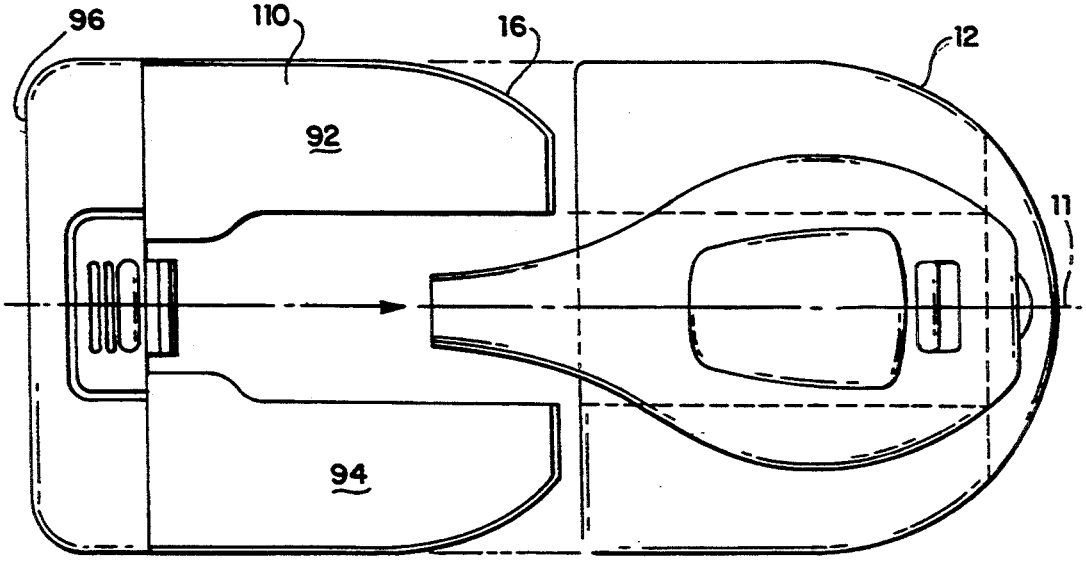
FIG. 5 is an exploded top view of the sanding machine showing how the debris container is attached to the housing.
Figure 6:
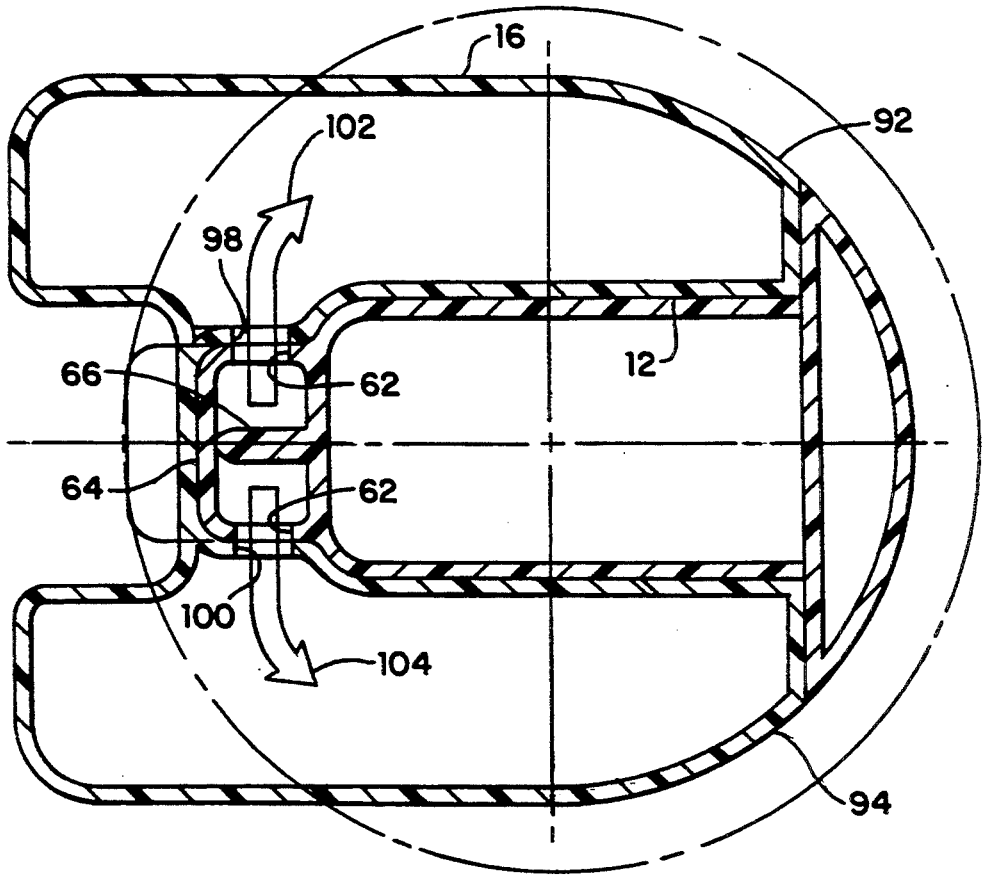
FIG. 6 is a cross-sectional top view showing the air flow paths into the debris container.

The details of the debris container 16 are shown in FIGS. 2, 5 and 6. As previously indicated, the debris container 16 has a horseshoe configuration having a pair of substantially parallel side members 92 and 94 slidably received in the debris container slots 72 and 74, respectively. The parallel side members 92 and 94 of the debris container 16 are hollow and straddle the waist portion 70 of the housing 12 on opposite sides thereof as shown in FIG. 2. The parallel side members 92 and 94 are connected at their rear ends by a transverse portion 96 which abuts against the rear end of the housing 12 when the parallel side members 92 and 94 are fully inserted into the slots 72 and 74, respectively.

As more clearly shown in the cross-sectional view of FIG. 6, the side member 92 has a debris entrance port 98 which is aligned with one of the exhaust ports 62 when the debris container 16 is fully inserted into the slots 72 and 74. In a like manner, side member 94 has a debris entrance port 100 which is aligned with the other exhaust port 62 when the debris container 16 is fully inserted into slots 72 and 74. The path of the debris and air flow from the exhaust chamber 50 through the conduit 64 into the hollow side members 92 and 94 of the dust container 16 is indicated by arrows 102 and 104. As previously described, the vertical air flow divider 66 directs the debris and air flow into the parallel side members 92 and 94 in substantially equal amounts.

The transverse portion 96 of the dust container 16 has a resilient catch 106, shown in phantom in FIG. 3 which engages a dog 107 provided at the rear end of housing 12 to lock the debris container 16 onto the housing. Depression of the catch 106 will release it from the dog 108 permitting the removal of the debris container 16 from housing 12. The cover 110 of the debris container 16 is removable permitting the collected dust and debris to be easily dumped without "bottle necking" in a narrow area when the debris container 16 is removed from the longitudinal slots 72 and 74. The insertion of the debris container 16 into the slots 72 and 74 locks the cover 110 in place and inhibits its accidental or inadvertent removal.

Each side member 92 and 94 may have one or more exit apertures provided in its external side wall which are covered by filter elements 112 and 114 shown in FIG. 1. These filter elements 112 and 114 may be of a woven mesh fabric molded directly into the debris container 16 during fabrication. Preferably, the mesh fabric is formed of woven monofilament nylon having a diameter of approximately 1.5 mils and is capable of removing dust particles from the air flowing therethrough down to 45 microns in diameter.

Alternatively, as shown in FIG. 6, the debris container may be molded from a porous high density polyethylene or polypropylene material such as Vyon® available from Industrial Products Division or Porvair International Limited of King Lynn, England. The use of these porous high density polyethylene or polypropylene materials renders the walls of the debris container 16 porous which will filter the sanding dust and debris from air flow as it passes out of the debris container 16 and eliminates the need for separate filter elements such as filter elements 112 and 114.

The diameter of the platen 14 is shown in phantom on FIG. 6. This shows that in the front and on both sides of the orbital sanding machine 10, the debris container lies within the diameter or footprint of the platen 14 and therefore will not interfere with or limit the surface engageable by the sanding platen 14.

Figure 7:
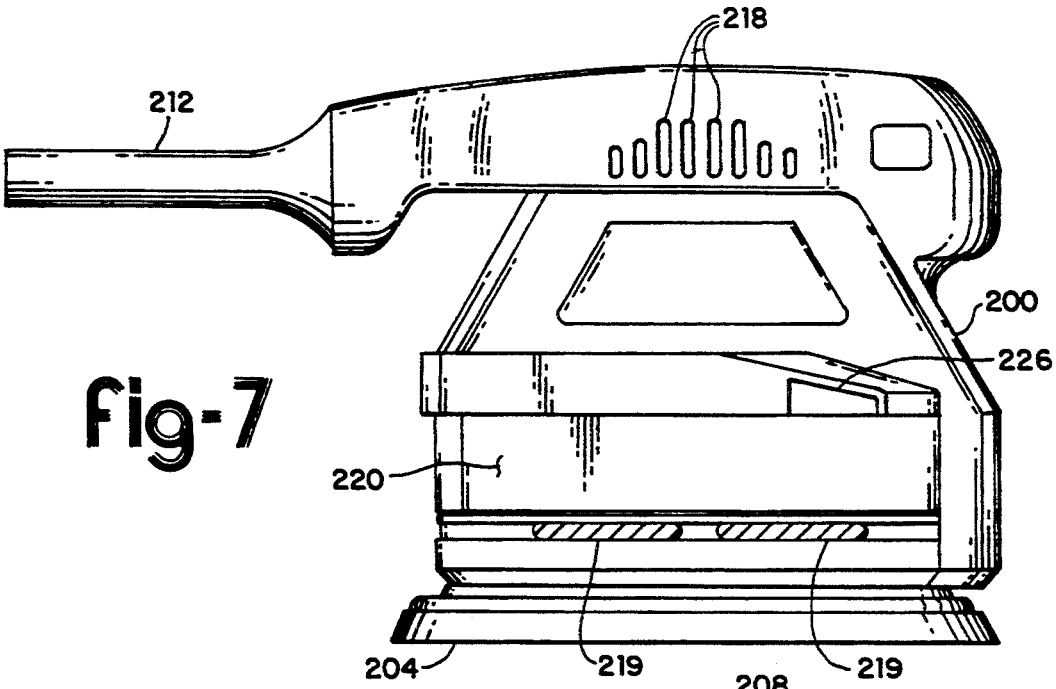
FIG. 7 is a side view of an alternate embodiment of the orbital sander.
Figure 8:
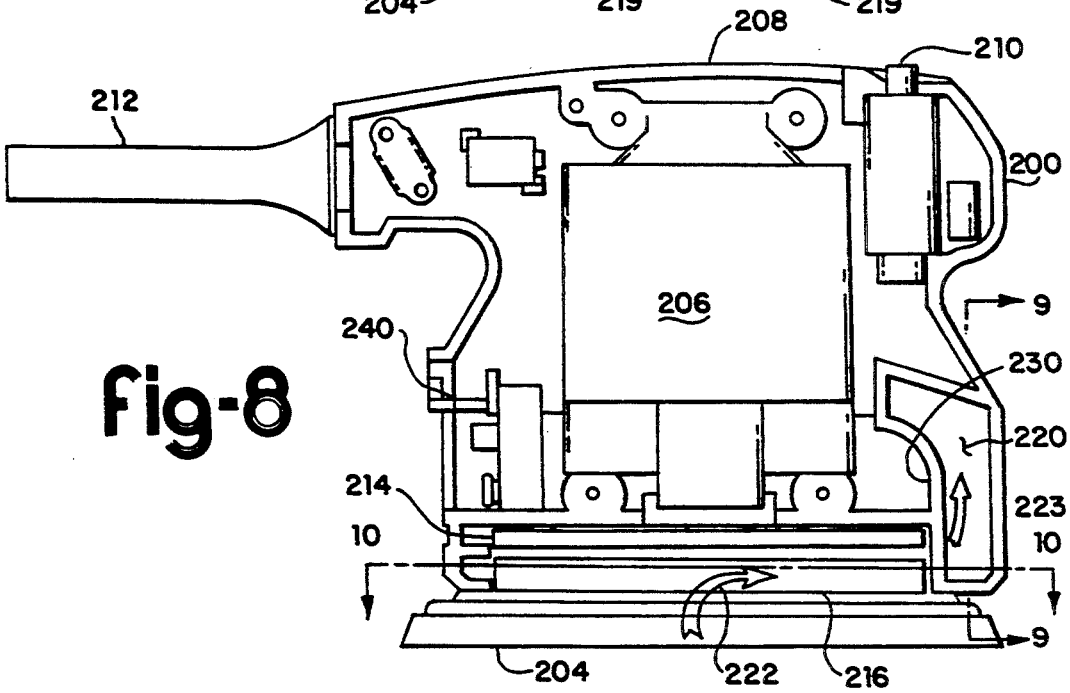
FIG. 8 is a cross-sectional side view of the alternate embodiment shown in FIG. 7.

An alternate embodiment of the random orbital sanding machine having a removable debris container is shown in FIGS. 7 through 16. Referring to FIGS. 7 and 8, the alternate embodiment has a housing 200 having a pair of longitudinal debris container slots, such as slot 202 operative to receive the removable debris container shown in FIGS. 12 through 16. The debris container slots of the housing 200 are structurally comparable to the longitudinal slots 72 and 74 of the embodiment shown in FIGS. 1–4. A sanding pad or platen 204 is connected to the rotary output shaft of a motor 206 fixedly mounted in the housing 200. A palm switch 208 is mounted on the top of the housing 200 and a lock-out button 210 is located forward of the palm switch 208. An electrical cord 212 connectable to a household outlet provides power to the orbital sanding machine.

As shown more clearly in FIG. 8, a cooling fan 214 and exhaust fan 216 are also attached to the output shaft of the electric motor 206. The cooling fan 214 conducts a cooling air flow around the motor 216. The cooling air flow enters the housing 200 through inlet vents, such as inlet vent 218, and exits the housing through exit vents 219, shown in FIG. 7. Comparable inlet and exhaust vents 218 and 219, respectively, are provided on opposite sides of the housing 200. The brushes of the electric motor 206 are disposed parallel to the longitudinal axis of the housing 200 providing the same advantages as described relative to the first embodiment.

Figure 9:
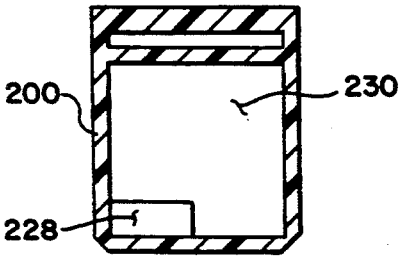
FIG. 9 is a partial cross-sectional view taken along section line 9—9 shown in FIG. 8.
Figure 10:
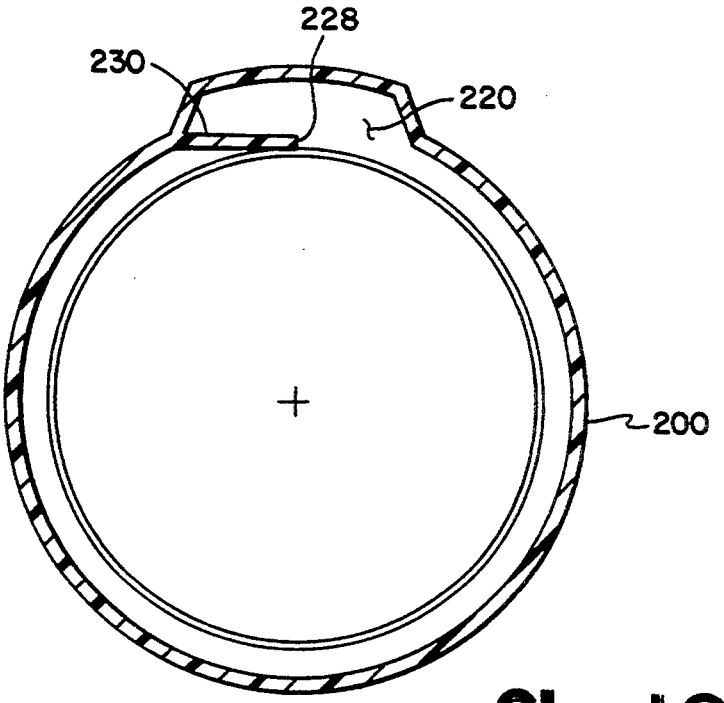
FIG. 10 is a partial cross-sectional view taken along section line 10—10 shown in FIG. 8.
Figure 11:
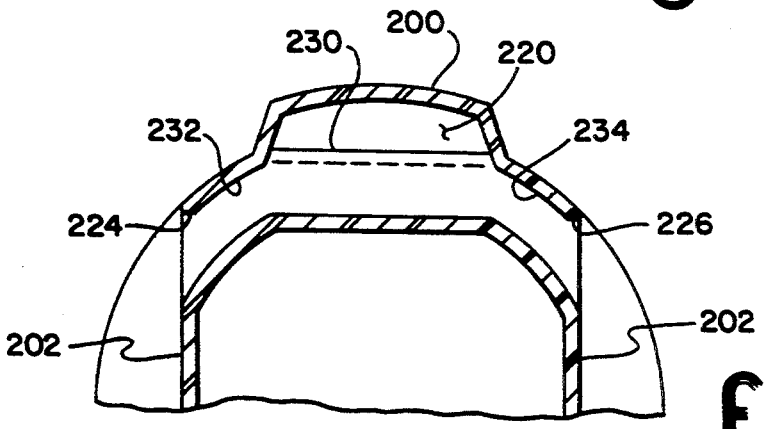
FIG. 11 is a partial cross-sectional view of the housing showing the transverse branches of the exhaust conduit.

The exhaust fan 216 produces an exhaust air flow from the vicinity of the platen 204 through a suction aperture, such as suction aperture 60, into an exhaust conduit 220 as indicated by arrows 222 and 223. The exhaust conduit 220, as shall be explained relative to FIGS. 9, 10 and 11, conducts the exhaust air flow produced by the exhaust fan to a pair of triangularly-shaped exhaust ports 224 and 226 disposed on opposite sides of the housing 200 immediately above the slots 202, as shown in FIGS. 7 and 11. FIGS. 9 is a cross-sectional view taken along section line 9—9 in FIG. 8, and FIG. 10 is a cross-sectional view taken along section line 10—10. As shown in FIGS. 9 and 10, the exhaust conduit 200 has a rectangular entrance portion 228 provided through the vertical internal wall 230 through which the air flow 222 from the exhaust fan 216 is received. The upper end of the exhaust conduit 220 has two transverse arcuate branches 232 and 234 which terminate in the triangularly-shaped exhaust ports 224 and 226, as shown in FIG. 11. These triangularly-shaped exhaust ports 224 and 226 exit the housing 200 at a location above the forward end of slots 202.

FIGS. 12 through 16 show the details of the debris container 236 receivable in the slots 202 of the housing 200. The debris container 236 is comparable to the debris container 16 of the embodiment shown in FIGS. 5 and 6. The debris container 236 is slidably receivable in the slots 202 and is locked in place by a spring catch 238, receivable in a slot 240 provided in the housing 200. The slot 240 is shown in FIG. 8. The debris container 236 has a hollow U-shaped configuration having a pair of parallel longitudinal legs 242 and 244 receivable in the slots 202 of the housing 200. The legs 242 and 244 straddle opposite sides of the waist of the housing 200. When the legs 242 and 244 of the debris container 236 are fully received into slots 202, the spring catch 238 is lockingly received in slot 240, locking the debris container to the housing. Depression of the spring catch 238 releases the debris container 238 from the housing 200.

The debris container 236 has an exit aperture provided through the outer surfaces of the longitudinal legs 242 and 244, respectively, such as exit aperture 246, shown in FIG. 13. Each exit aperture 246 has a plurality of vertical fins 248 which direct the exhaust air flow in a direction toward the rear of the debris container 236. The exit apertures 246 are covered by a woven mesh filter element 250, which removes the dust and debris from the exhaust air flow as it exists the debris container 236.

Figure 14:
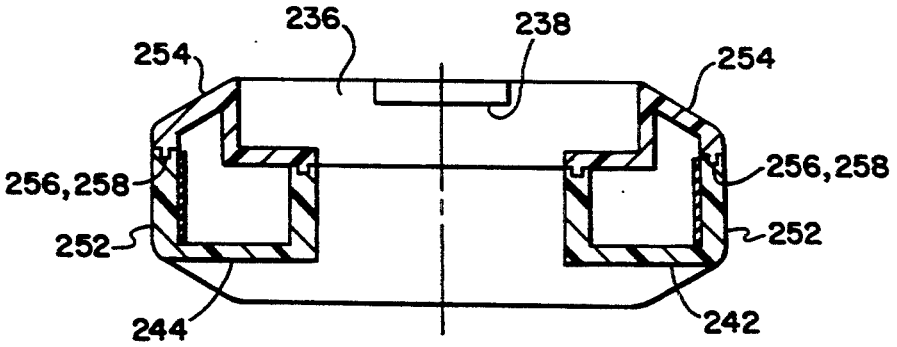
FIG. 14 is a cross-sectional view taken along section line 14—14 of FIG. 12.

As shown more clearly in FIGS. 14, the debris container comprises a body 252 and a cover 254. The body 252 has a set of grooves 256 which receive mating tongues 258, provided on the cover 254 to lock the cover 254 to the body 252 in a longitudinal and transverse direction, but permits the cover 254 to be vertically separated from the body 252 to empty the debris collected therein. The cover 254 is locked on the body 252 when the debris container 236 is locked in the slots 202.

The cover 254 has a debris entrance port, such as debris entrance port 260, provided on the cover portion of the longitudinal legs 242 and 244, as shown in FIG. 15. The debris entrance ports 260 mate with the exhaust ports 224 and 226 of the housing 200 when the debris container 236 is fully inserted into the slots 202, thus providing a continuous air flow path from the exhaust conduit 220 into the debris container 236. An aperture 262 provided in the top of the body 252 is adjacent to the debris entrance ports 260, as shown in FIG. 16, conducts the exhaust air flow received through the entrance port 260 into the interior of the hollow debris container 236. The exhaust air flow exits the debris container 236 through the exit apertures 246 as previously described.

In operation, the exhaust fan 216 produces an air flow from the region adjacent to and surrounding the sanding platen 204 through the exhaust conduit 220 into the debris container 236. The filter element 250 filters the sanding dust and debris from the exhaust air flow as it exits the debris container 236. The debris container 236 collects the sanding dust and debris filtered from the exhaust air flow. After a sufficient amount of debris is collected in the debris container, the debris container may be removed from the housing 200 and emptied. The removable cover 254 facilitates the removal of the debris from the body 252. After emptying the debris container 236, the cover 254 is replaced on the body 252 and the debris container 236 is re-inserted in slots 202.

Figure 17:
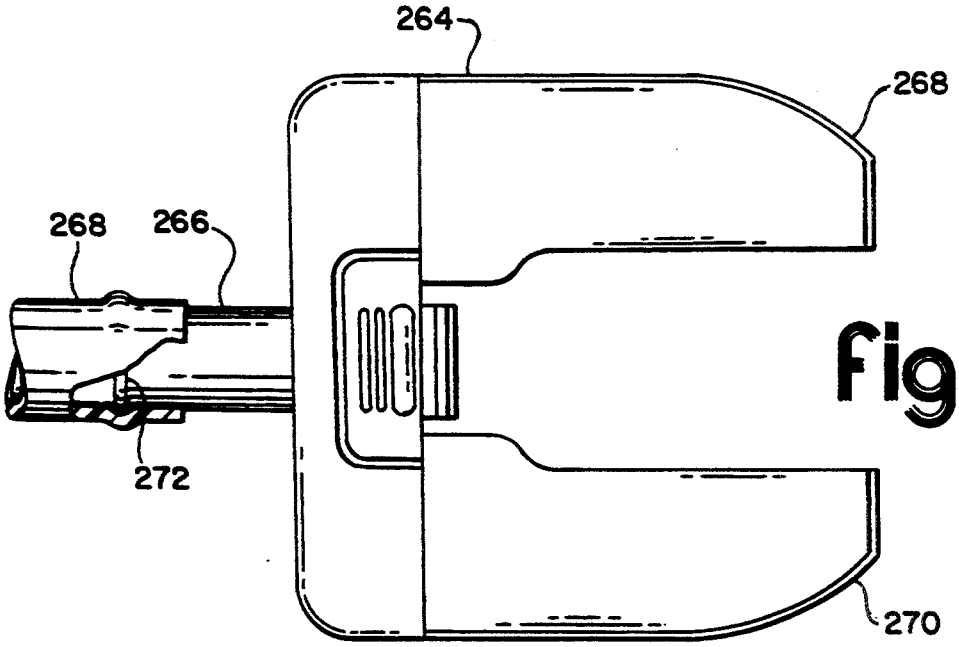
FIG. 17 is a top view of a vacuum accessory for the embodiment of the sanding machine shown in FIG. 1.
Figure 18:
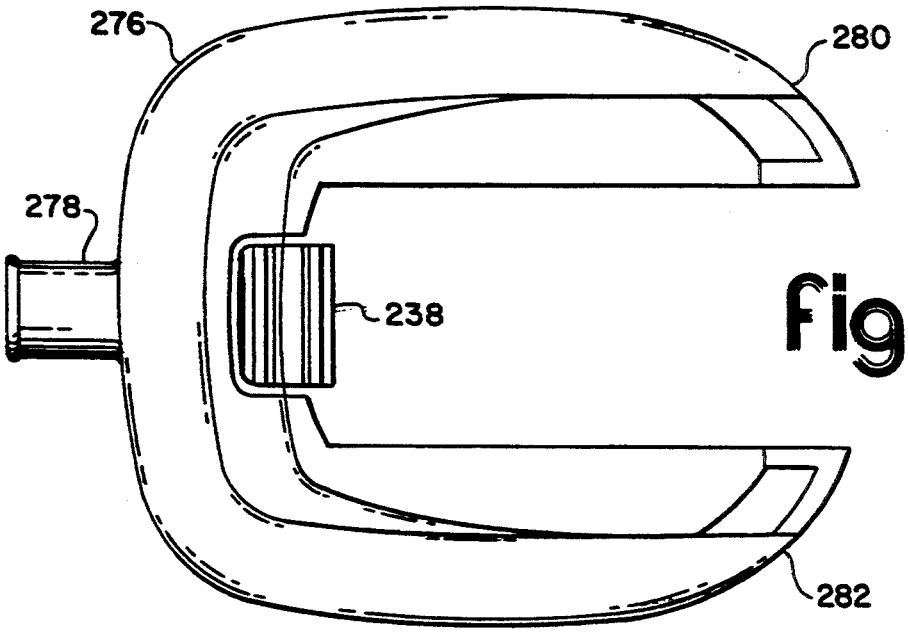
FIG. 18 is a top view of a vacuum accessory for the embodiment of the sanding machine shown in FIG. 7.
Figure 19:
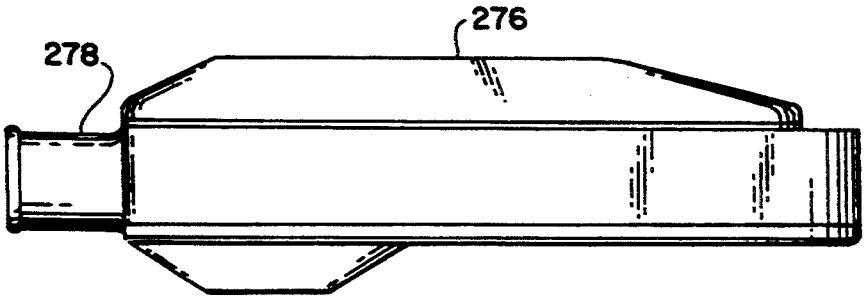
FIG. 19 is a side view of the vacuum accessory of FIG. 18.

When a vacuum source is readily available, the debris containers 16 or 236 may be replaced by a vacuum accessory such as shown on FIGS. 17–19. The vacuum accessory 264 shown in FIG. 17 has substantially the same horseshoe shaped configuration as the debris container 16 less the exit ports and filter elements 112 and 114. In place of the exit ports, the vacuum accessory 264 has a vacuum hose connector 266 to which is connected a vacuum hose 268 connected to the vacuum source. Like the debris container 16, the vacuum attachment has a pair of longitudinal legs 268 and 270 which straddle the waist portion 70 of the sanding machine 10. The vacuum hose connector 268 is internally connected to the exhaust ports 62 of housing 12 when the legs 268 and 270 are fully inserted into slots 72 and 74, respectively. The vacuum hose connector may have one or more annular ribs 272, only one of which is shown, which frictionally engage the inside surface of the vacuum hose 268. Alternatively, an annular pressure clamp may be used to secure the vacuum hose to the vacuum hose connector 266.

In a like manner, the debris container 236 may also be replaced with a horseshoe shaped vacuum attachment 276 having a vacuum hose connector 278 as shown in FIGS. 17 and 18. The vacuum attachment 276 also has a pair of hollow legs 280 and 282 which straddle the waist of the housing 200 in the same manner as the legs 242 and 244 of the debris container 236. The vacuum hose connector 278 is connected to the exit ports 224 and 226 disposed on opposite sides of the housing 200 through the legs 280 and 282. The vacuum attachments 264 and 276 permits the orbital sanding machine 10 to be used with either the debris containers, 16 or 236, or with an external vacuum source at the option of the user.

Having described the invention with regard to a preferred and alternate embodiment as shown in the attached drawings, it is recognized that those skilled in the art can conceive various modifications and adaptations to the disclosed embodiments within the scope of the invention as set forth in the appended claims.

What is claimed is:

1. A surface treating tool comprising:

a housing having a pair of longitudinal slots provided along opposite sides thereof;

an electric motor disposed in said housing, said electric motor having a vertically oriented output shaft;

a platen disposed normal to said output shaft, said platen having a surface for supporting an abrasive element;

an eccentric rotatably connecting said platen to said output shaft, said platen responsive to the rotation of said eccentric by said electric motor to move with an orbital motion in the plane of said surface;

a U-shaped debris container removably attachable to said housing, said U-shaped debris container having a pair of spatially separated substantially parallel hollow side members, each of said hollow side members being slidably receivable in a respective one of said pair of longitudinal slots on opposite sides of said housing, each of said hollow side members having an entrance port, and filter means for removing said debris from said air flow as it exits each hollow side member of said debris container; and means disposed in said housing for producing an exhaust air flow to draw debris from the vicinity of said platen into said debris container through said entrance port in response to the rotation of said output shaft.

2. The surface treatment tool of claim 1 wherein means for producing an exhaust air flow comprises:

an exhaust fan chamber provided in said housing in a region adjacent to said platen, said exhaust fan chamber having at least one inlet port adjacent to said platen and at least one exhaust port; and an exhaust fan disposed in said exhaust fan chamber, said exhaust fan being attached to said output shaft of said electric motor and rotatable therewith, said exhaust fan producing said exhaust air flow from said at least one inlet port through said exhaust port, said exhaust air flow being sufficient to draw debris from the vicinity of said platen and to transport said debris to said debris container through said exhaust port.

3. The surface treating tool of claim 2 wherein said housing further comprises:

a motor chamber enclosing said electric motor;

at least one cooling air inlet vent provided through said housing adjacent to one end of said electric motor;

at least one cooling air exit port provided through said housing adjacent to an end of said electric motor opposite said one end; and wherein said tool further includes a cooling fan disposed in said motor chamber, said cooling fan attached to said output shaft adjacent to said end of said electric motor opposite said one end, said cooling fan producing an air flow through said motor chamber from said at least one cooling air inlet vent to said cooling air exit port, to cool said electric motor.

4. The surface treating tool of claim 3 wherein said housing has an internal rib separating said motor chamber from said exhaust chamber, and wherein said internal rib has a rotor aperture therethrough, said cooling fan and said exhaust fan comprises:

a rotor disc disposed in said rotor aperture, said rotor disc attached to said output shaft and rotatable therewith, said rotor having a first side facing said motor chamber and a second side facing said exhaust chamber;

a plurality of radially disposed cooling fan blades provided on said first side of said rotor; and a plurality of radially disposed exhaust fan blades provided on said second side of said rotor.

5. The surface treating tool of claim 4 wherein said rotor aperture in said internal rib has an annular lip extending radially inwardly.

6. The surface treating tool of claim 1 wherein said electric motor has an armature, a commutator attached to said output shaft, and a pair of brushes engaging said commutator to provided electrical power to said armature, said commutator and said pair of brushes being dispose in said housing intermediate said longitudinal slots.

7. The surface treating tool of claim 6 wherein said housing has a longitudinal axis parallel to said longitudinal slots, said brushes being disposed in said housing parallel to said longitudinal axis.

8. The surface treating tool of claim 1 further including means for locking said U-shaped debris container to said housing with said hollow side members are fully received in said longitudinal slots.

9. The surface treating tool of claim 1 wherein said U-shaped debris container has a removable cover.

10. The surface treating tool of claim 1 wherein each of said hollow side members has an external surface on the side opposite said housing, said filter means comprising at least one exit aperture provided through said external surface of each of said hollow side members and a woven mesh filter element attached to each of said hollow side members covering said at least one aperture.

11. The surface treating tool of claim 1 wherein said U-shaped debris container is made from a porous plastic material and said filter means comprises the walls of said U-shaped debris container.

12. The surface treating tool of claim 1 wherein said platen has a plurality of holes provided therethrough normal to said surface for supporting an abrasive element.

13. The surface treating tool of claim 12 wherein said abrasive element has a plurality of holes therethrough axially aligned with said plurality of holes provided through said platen.

14. The surface treating tool of claim 1 wherein said debris container lies within a footprint of said platen on at least three sides thereof.

15. The surface treating tool of claim 1 further including a horseshoe shaped vacuum attachment removably attachable to said housing in place of said debris container, said horseshoe shaped vacuum attachment having a pair of substantially parallel legs and a vacuum hose connector connected to said exhaust fan chamber when said parallel legs are fully received in said longitudinal slots.

16. A random orbital sanding machine comprising:

a housing having a longitudinal axis and a vertical axis normal to said longitudinal axis, said housing having a pair of slots provided on opposite sides thereof parallel to said longitudinal axis;

an electric motor mounted in said housing, said motor having an output shaft disposed parallel to said vertical axis;

a platen disposed normal to said vertical axis and adjacent to a bottom surface of said housing, said platen having a surface for supporting an abrasive element, said platen further having a plurality of holes provided therethrough in a direction parallel to said vertical axis;

an eccentric element having one end fixedly attached to said output shaft and a second end rotatably attached to said platen;

a U-shaped debris container removably attachable to said housing, said U-shaped debris container having a pair of spatially separated hollow portions substantially parallel to each other and connected to each other at one end thereof by a transverse portion, each of said hollow portions being slidably receivable in a respective one of said pair of longitudinal slots on opposite sides of said housing, each of said hollow portions having an entrance port;

means disposed in said housing for producing an air flow to draw debris from the vicinity of said platen into said debris container through said entrance port in response to the rotation of said output shaft; and means for locking said U-shaped debris container on said motor housing.

17. The machine of claim 16 wherein said mean for producing an air flow comprises:

an exhaust fan chamber provided within said housing adjacent to said bottom surface, said exhaust chamber having at least one inlet port provided through said bottom surface in fluid communication with said plurality of holes provided through said platen and at least one exit port which mates with said entrance port of each hollow portion of said debris container; and an exhaust fan disposed in said exhaust fan chamber, said exhaust fan responsive to a rotation of said output shaft to produce an air flow from said at least one inlet port into said debris chamber through said exhaust port when said hollow portions of said debris container are received in said longitudinal slots.

18. The machine of claim 17 wherein said housing further comprises a motor chamber enclosing said electric motor, said motor chamber having at least one inlet vent provided adjacent to a first end of said electric motor and an outlet vent provided adjacent to a second end of said electric motor, said machine further comprising a cooling fan disposed in said motor chamber, said cooling fan attached to said output shaft and responsive to a rotation of said output shaft to produce an air flow through said motor chamber from said inlet vent out through said outlet vent cooling said electric motor.

19. The machine of claim 18 wherein an internal rib separates said motor chamber from said exhaust fan chamber and wherein said internal rib has a rotor aperture, said exhaust fan and said cooling fan comprises:

a rotor disposed in said rotor aperture, said rotor attached to said output shaft and rotatable therewith, said rotor having a first side facing said motor chamber and a second side facing said exhaust fan chamber;

a plurality of radially extending cooling fan blades provided on said first side of said rotor; and a plurality of radially extending exhaust fan blades provided on said second side of said rotor.

20. The machine of claim 16 wherein said electric motor has an armature, a commutator attached to said output shaft and a pair of brushes electrically engaging said commutator to provide electrical power to said armature, said commutator and said pair of brushes being disposed in said housing between said longitudinal slots, said brushes being disposed parallel to said longitudinal axis of said housing to permit said longitudinal slots to have a significantly increased depth.

21. The machine of claim 20 further including a horseshoe shaped vacuum attachment removably attachable to said housing in place of said debris container, said vacuum attachment having a pair of substantially parallel legs, each leg receivable in a respective one of said longitudinal slots and a vacuum hose connector connected to said exit port of said exhaust fan chamber when said legs of said vacuum attachment are received in said longitudinal slots.

22. The machine of claim 16 wherein each of said spatially separated hollow portions of said debris container has an exit port, said filter means is a woven mesh filler element disposed over said exit port.

23. The machine of claim 16 wherein said debris container has porous plastic walls and wherein said filter means is said porous plastic walls.

24. The machine of claim 16 wherein said at least one exit port comprises two exit ports, each of said exit ports of said two exit ports interfacing entrance and entrance port of a respective one of said hollow portions.

25. The machine of claim 24 further comprising an air flow conduit disposed between said exhaust fan chamber to said two exit ports, said air flow conduit having a divider element directing the air flow through said conduit to said two exit ports.

26. The machine of claim 16 wherein said debris container has a removable cover.

27. The machine of claim 16 wherein at least three sides of said debris container lies within the footprint of said platen.

* * * * *